United States Patent [19]

Gorbaty et al.

[11] 4,089,772

[45] May 16, 1978

[54] ALKYLATION OR ACYLATION OF LIQUEFACTION PRODUCT BOTTOMS

[75] Inventors: Martin Leo Gorbaty, Fanwood; Richard Henry Schlosberg, New Providence, both of N.J.

[73] Assignee: Exxon Research & Engineering Co., Linden, N.J.

[21] Appl. No.: 688,526

[22] Filed: May 21, 1976

[51] Int. Cl.[2] ..... C10G 1/06
[52] U.S. Cl. ..... 208/8; 208/10
[58] Field of Search ..... 208/8–10

[56] References Cited

U.S. PATENT DOCUMENTS

| | | | |
|---|---|---|---|
| 3,158,561 | 11/1964 | Neuworth et al. | 208/8 |
| 4,033,852 | 7/1977 | Horowitz et al. | 208/8 |

OTHER PUBLICATIONS

Hodek et al, "Increased Extraction of Coals on Acylation", Fuel, vol. 52, Jul., 1973, pp. 220–225.

Sternberg et al, "Solubilization of an LVB Coal by Reductive Alkylation", Fuel, vol. 50, 1971, pp. 432–442.

*Primary Examiner*—Delbert E. Gantz
*Assistant Examiner*—James W. Hellwege
*Attorney, Agent, or Firm*—Roy J. Ott; James H. Callwood

[57] ABSTRACT

The production of liquid hydrocarbons from coal via liquefaction is enhanced by recovering a bottoms fraction from the coal liquefaction reaction and subjecting the bottoms fraction to alkylation or acylation prior to recycling this bottoms fraction to the liquefaction reaction zone. The introduction of aliphatic hydrocarbon radicals or acyl radicals, including carbon monoxide, into the highly refractory molecules of the bottoms product from coal liquefaction permits additional amounts of the coal to undergo liquefaction at suitable liquefaction conditions.

5 Claims, 1 Drawing Figure

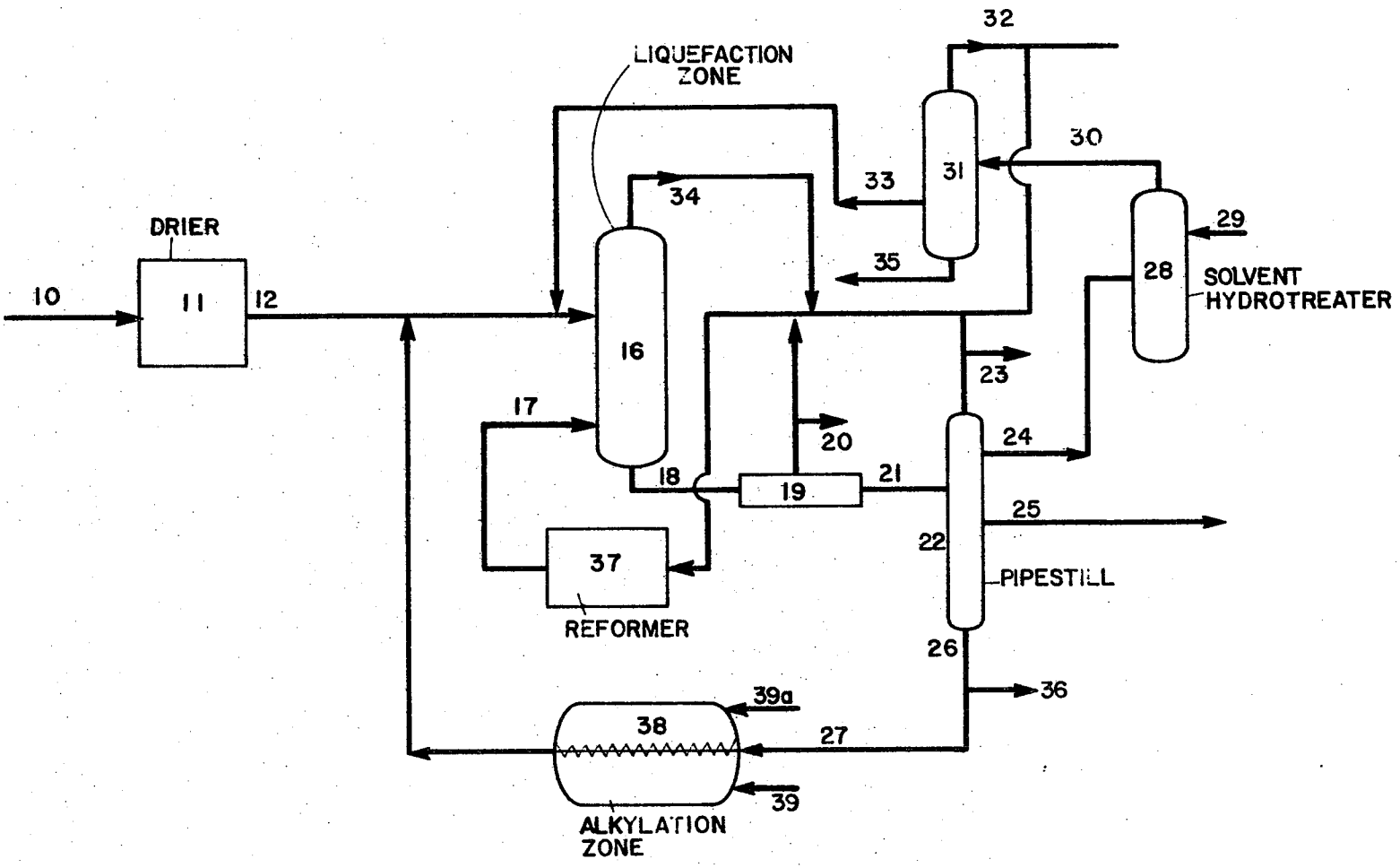
SOLVENT HYDROTREATER
PIPESTILL
LIQUEFACTION ZONE
REFORMER
ALKYLATION ZONE
DRIER
10
11
12
16
17
18
19
20
21
22
23
24
25
26
27
28
29
30
31
32
33
34
35
36
37
38
39
39a

ALKYLATION OR ACYLATION OF LIQUEFACTION PRODUCT BOTTOMS

BACKGROUND OF THE INVENTION

1. Field of the Invention

This invention relates to an improved process for producing liquid hydrocarbons from coal. More particularly, this invention relates to a process for enhancing liquid hydrocarbon yields from solid coal by subjecting the coal to suitable liquefaction conditions, recovering a bottoms stream comprising unconverted coal which is then subjected to alkylation or acylation and subjecting the alkylated/acylated bottoms to further liquefaction.

2. Discussion of the Prior Art

In recent years, the production of liquid hydrocarbons from non-petroleum sources has taken on added importance. Thus, with proven world petroleum reserves shrinking, other forms of energy have attracted attention. Perhaps, the greatest attention has been directed to coal, an abundant fossil fuel, particularly in the United States, which can be converted to liquid hydrocarbons at costs approaching current and projected costs for the refining of crude petroleum. Moreover, basic coal conversion technology exists and has been demonstrated on a variety of levels, e.g., pilot plant and full scale commercial (although highly expensive) plants. However, full development of existing conversion technology is only now underway.

Coking of coal with the attendant recovery of coal liquids is a long established process. Solvation of coal, with or without the addition of molecular hydrogen has also long been known as a feasible, if not economically attractive, process for producing coal liquids (see, for example, U.S. Pat. No. 1,342,790). The Pott-Broche Process (for example, U.S. Pat. No. 1,881,977) with modifications, was capable of producing gasoline from coal, albeit at then excessive costs. A number of process schemes for the liquefaction of coal using hydrogen donor solvents has also been suggested (for example, U.S. Pat. No. 3,617,513).

While there has been great emphasis on the conversion of coal to more useful liquid and gaseous products the investigation of the coal molecule, i.e., that which is to be converted, has often lagged and has been of relatively little importance. Nevertheless, an understanding of the material to be converted is elementary to the development of sound conversion technology. As a result, the chemistry of coal is now being actively pursued and while the structure of coal remains, for the most part, unresolved, it is now generally believed that the coal molecule is not constructed on a diamond-like framework but rather it contains aromatic rings which are highly substituted (i.e., fused to other aromatics or hydroaromatics, or attached to alkyl, ether, hydroxyl, etc. groups). Additionally, it is now believed that coal exhibits secondary structural characteristics such as hydrogen bonding, interaromatic ring bonds, etc., which generate the three-dimensional structure of coal. As a result of the condensed ring structure of coal, liquefaction processes have generally been limited by their ability to solvate exposed areas of the coal molecule. Thus, under normal liquefaction conditions, the secondary structural characteristics of the coal molecule are only partially, if at all, destroyed and a significant portion of the coal is not converted in the liquefaction process.

In copending application Ser. No. 635,706 filed Nov. 26, 1975 it has been disclosed that pretreatment of coal by alkylation or acylation can affect the secondary structural characteristics of coal and provide additional reaction sites for the liquefaction reaction. The copending application also discloses that the bottoms fraction from the liquefaction reaction can be further alkylated-/acylated and then again subjected to liquefaction conditions. It has now been found that increased liquid hydrocarbon yields can be obtained from solid coal by alkylating/acylating the recovered bottoms streams from a liquefaction reaction zone. Thus, enhanced liquid yields can be obtained by alkylating/acylating a much smaller coal-containing stream than was previously thought possible. In the copending application, the entire coal feed was subjected to alkylation/acylation while this invention teaches that only the bottoms stream need be treated to obtain increased liquid yields.

It is believed that the highly refractory nature of the coal bottoms can be broken down by the introduction of alkyl or acyl radicals into the coal molecule. Thus, additional reactive sites are created in the converted coal which are susceptible to conversion during liquefaction.

Coal has been alkylated primarily for investigation of the coal molecule. See, for example, C. Kröger, *Forshungs Ber. Nordrhein-Westfalen* No. 1488 (1965); H. W. Sternberg and C. L. Delle Donne, *Fuel,* 53, 172 (1974); H. W. Sternberg, C. L. Delle Donne, P. Pantages, E. C. Moroni and R. E. Markby, *Fuel,* 50, 432 (1971); J. D. Spencer and B. Linville, *Bureau of Mines Energy Program,* 1971, Bureau of Mines 1C8551, 1972; B. Linville and J. D. Spencer, *Review of Bureau of Mines Energy Program,* 1970, Bureau of Mines 1C8526, 1971; W. Hodek and G. Kölling, *Fuel,* 52, 220 (1973) discuss the increase in extractability of bituminous coal by the related Friedel-Crafts acylation. Nevertheless, no prior reference has suggested that increased yields of liquid products via liquefaction can be obtained by first subjecting the coal to either alkylation or acylation. See, also, F. Meyer, Ph.D. Thesis, University of Munster, 1969; J. D. Spencer, *Review of Bureau of Mines Coal Program,* 1968, Bureau of Mines, 1C8416, 1969; J. D. Spencer, *Review of Bureau of Mines Coal Program,* 1969, Bureau of Mines, 1C8385, 1968, Sternberg, H. W. et al, The Electrochemical Reduction of a Low Volatile Bituminous Material, *Fuel,* 45 (6) 409–482 (1966). In "Coal Liquefaction by Alkylation Techniques," D. D. Denson and D. W. Buckhouse in a Stanford Research Institute paper dated June 20, 1975 prepared under a National Science Foundation grant, alkylation was utilized to enhance solvent refining but, again, no mention was made of enhancing liquid product yields by converting the coal under liquefaction conditions.

SUMMARY OF THE INVENTION

Now, in accordance with this invention, it has been discovered that the production of liquid hydrocarbons, particularly light hydrocarbons, can be enhanced for a coal liquefaction process by separating and recovering a bottoms stream containing substantially all of the unconverted coal, subjecting at least a portion of the bottoms to alkylation or acylation and further reacting the alkylated/acylated bottoms stream at normal liquefaction conversion conditions. Thus, the liquid product from coal liquefaction is increased due to the incremental amount of liquid resulting from the previously unconverted coal.

The structure of unconverted coal is altered by the introduction of aliphatic hydrocarbon radicals (alkylation) or acyl radicals (acylation). The process can be exemplified as follows:

(1) alkylation

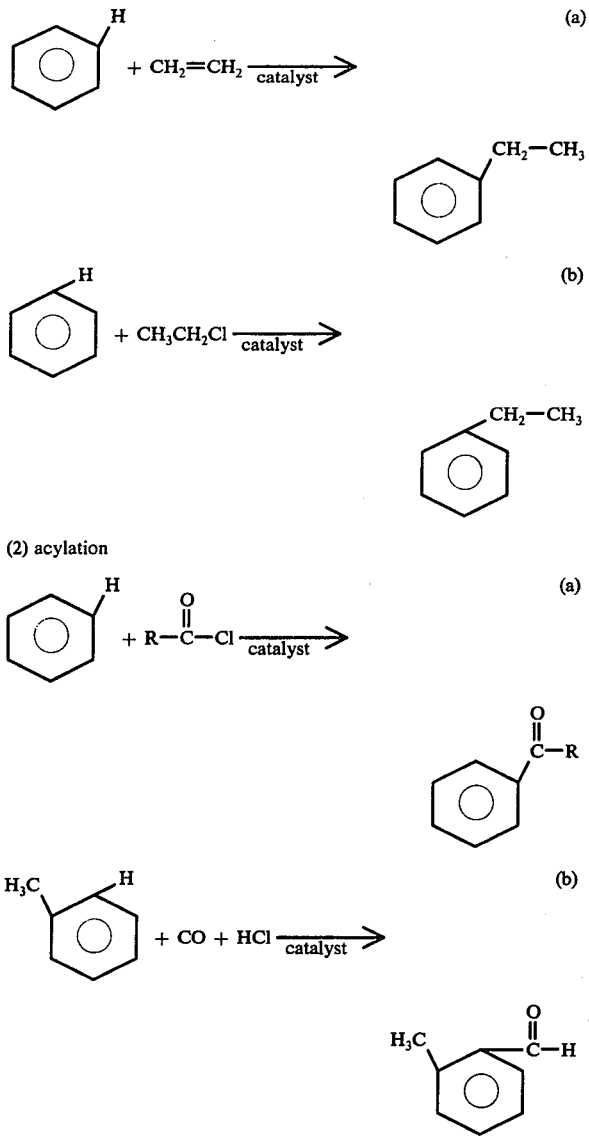

Thus, equation (1) represents olefin alkylation of an aromatic ring that might be present in the coal molecule and equation (2) similarly represents the acylation of the aromatic ring. It should be noted that for the purposes of this specification, acylation includes the reaction of HCl and CO, in the presence of a Friedel-Crafts catalyst to synthesize aldehydes, i.e., formylation. This reaction is commonly known as the Gatterman-Koch reaction in which a CO group is introduced into aromatic molecules under the influence of a Friedel-Crafts catalyst, usually aluminum chloride or aluminum bromide. See, for example, Friedel-Crafts and Related Reactions, J. Wiley & Sons Inc. (1964), edited by G. A. Olah, pp. 1154–1177.

While not wishing to be bound by theoretical considerations, it is believed that the size of the alkylating or acylating agent is an important consideration. Thus, it is believed that, in general, the bulkier the attached agent the better will be the results upon subsequent liquefaction. Consequently, branched or cyclic compounds are preferred to straight chain compounds having the same number of carbon atoms. Since the macromolecular coal structure is believed to be opened up by these compounds, the bulkier the radical the greater its effect in producing available sites for liquefaction. In the same vein, it is desirable to introduce as many of these radicals into the coal structure as technology and economics allow. Therefore, in a preferred embodiment, the bottoms stream may be subjected to multiple alkylation cycles to increase the number of radicals introduced into the coal structure.

In a preferred embodiment, the alkylated or acylated bottoms stream is recycled and is liquefied in the presence of hydrogen or a hydrogen donor solvent or both. It should be understood, however, that the advantageous results achieved through the alkylation or acylation of the bottoms stream can be realized in any liquefaction system, some of which will be described hereinbelow. Nevertheless, it is preferred to employ hydrogen donor solvent liquefaction and to operate a hydrogen donor solvent liquefaction zone at temperatures of about 650° F. to about 1000° F., preferably about 700° to 900° F., pressures of about 100 to about 3000 psig, preferably about 1250 to 2500 psig, and a solvent/coal weight ratio of from 0.5/1 to 4/1, preferably about 1/1 to 2/1.

DESCRIPTION OF THE DRAWING

FIG. 1 schematically shows one method for effecting this invention.

DETAILED DESCRIPTION

The products of a coal liquefaction conversion process are normally light gases, liquid products and a bottoms fraction of unconverted coal and ash. Formerly, the unconverted coal remaining after liquefaction was considered to be coal that was not susceptible to liquefaction because of the refractory nature of the material.

Generally, any type of coal can be utilized in the process of this invention, such as bituminous, subbituminous, lignite, etc., preferably bituminous or subbituminous; the coal is generally ground to a finely divided state and will contain particles less than about ¼ inch in size, preferably less than about 8 NBS sieve size mesh, more preferably less than about 100 NBS sieve size mesh. The coal can be dried by conventional drying techniques, for example, by heating to about 100° to 110° C., but below temperatures that might cause other reactions when susceptible coals are employed. The dried coal is then subjected to liquefaction. Various liquefaction processes can be employed such as hydrogenation with or without a catalyst, catalytic hydrogenation in the presence of a donor or non-donor solvent, or liquefaction by the donor solvent method, the latter being preferred particularly with the presence of hydrogen during the liquefaction step. One hydrogen donor solvent liquefaction process is described in U.S. Pat. No. 3,617,513. As used in this specification, liquefaction means the conversion of coal as distinguished from mere solvent extraction where essentially no conversion takes place, e.g., extraction with solvents such as benzene, pyridine or tetrahydrofuran at room temperature or temperatures ranging up to the boiling point of the extractive solvent. Thus, substantial chemical reaction does not occur until temperatures are raised above about 150° C., preferably above about 200° C. Liquefaction, as opposed to solvent extraction, utilizes a vehicle rather than an extraction solvent, and is a more severe operation, maximizes light liquid yields and involves substantial chemical reaction of the coal. Solvent extraction tends to maximize heavier liquid yields, e.g., fuel oil and higher boiling constituents while involving little or no chemical reaction due to the temperatures involved, e.g., less than about 200° C. Additionally, maximizing light liquid yields allows for separation of the bottoms by distillation, e.g., vacuum distillation, rather than by filtration which is used for solvent refined coals.

Briefly, however, hydrogen donor solvent liquefaction utilizes a hydrogen donating solvent which is composed of one or more donor compounds such as indane, $C_{10}$–$C_{12}$ tetralins, $C_{12}$–$C_{13}$ acenaphthenes, di-, tetra-, and octahydroanthracenes and tetrahydroacenaphthene as well as other derivatives of partially saturated hydroaromatic compounds. The donor solvent can be the product of a coal liquefaction process and can be a wide boiling hydrocarbon fraction, for example, boiling in the range of about 300°–900° F., preferably about 375° F. to 800° F. The boiling range is not critical except insofar as a substantial portion of the hydrogen donor molecules are retained in the liquid phase under liquefaction conditions. Preferably, the solvent contains at least about 30 wt. %, more preferably at least about 50 wt. %, based on solvent, of compounds which are known hydrogen donors under liquefaction conditions. Thus, the solvent is normally comprised of donor and non-donor compounds.

The donor solvent can be obtained by hydrogenating coal liquids derived from liquefaction, for example, the composition of the hydrogen donor solvent will vary depending upon the source of the coal feed, the liquefaction system and its operating conditions and solvent hydrogenation conditions. A typical inspection of a hydrogenated liquefaction recycle stream useful as a donor solvent is shown in Table II of U.S. Pat. No. 3,617,513, said table being incorporated herein by reference.

The coal is then slurried in the hydrogen donor solvent, preheated to about reaction temperature in a slurry pre-heater, and passed to a liquefaction zone wherein the convertible portion of the coal is allowed to disperse or react.

The solvent/coal ratio, when about 50 wt. % of the solvent is hydrogen donor type compounds, can range from about 0.5:1 to 4:1, preferably about 1:1 to 2:1. Preferably the donor solvent contains at least about 25% hydrogen donor compounds, more preferably at least about 33% hydrogen donor compounds. Operating conditions can vary widely, that is, temperatures of about 600° F. to 1000° F., preferably about 750° to 900° F.; pressures of about 300 to 3000 psig, preferably about 1000 to 2500 psig; residence times of about 5 minutes to 200 minutes; and molecular hydrogen input of about 0 to 4 wt. % (based on m.a.f. coal charged to the liquefaction zone in the slurry). The primary products removed from the liquefaction zone are light gases, liquid products and a slurry of unconverted coal and ash in heavy oil. Since the liquid state products contain the donor solvent in a hydrogen depleted form the liquid can be fractionated to recover an appropriate boiling range fraction which can then be hydrogenated and returned to the liquefaction zone as recycle, hydrogenated donor solvent.

Recycle solvent, preferably boiling in the range of about 350° to 800° F., separated from the liquid product of the liquefaction zone, can be hydrogenated with hydrogen in the presence of a suitable hydrogenation catalyst. Hydrogenation temperatures can range from about 650° to 850° F., pressures can range from about 650 to 2000 psig, space velocities of 1 to 6 weights of liquid per hour per weight of catalyst can be employed. A variety of hydrogenation catalysts can be employed such as those containing components from Group VIB and Group VIII, e.g., cobalt molybdate on a suitable support such as alumina, silica, titania, etc. The hydrogenated product is then fractionated to the desired boiling range and recycled to the liquefaction zone or slurried with the coal prior to entry into the liquefaction zone.

Alkylation and acylation can be broadly characterized as electrophilic substitution reactions. More particularly, the alkylation or acylation of coal can be characterized as an electrophilic substitution wherein the aromatic carbon-hydrogen bond, e.g., aromatic C–H of the coal molecule, is the site of primary attack by the alkylating or acylating agent.

Alkylation and acylation are well known and well documented reactions. The use of coal liquefaction bottoms as the material to be alkylated or acylated does not change the chemistry of the reaction or the manner in which the reaction proceeds. Consequently, a bottoms stream can be alkylated or acylated at conditions amenable to alkylation or acylation of many other materials, particularly those of an aromatic nature. The bottoms stream can be described as a slurry and in this state contact with the alkylating or acylating reagent which may be either a liquid or a gas at reaction conditions is facilitated. Generally, any compound capable of being an acylating agent or an alkylating agent can be employed.

In the case of acylation, the reagent may be any compound containing an acyl group, that is,

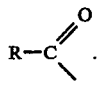

Thus, acyl halides, e.g., iodide, bromide, chloride, or fluoride, can be employed as well as phosgene, and compounds generally of the formula

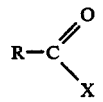

wherein X may be a halogen (i.e., iodine, bromine, chlorine, fluorine),

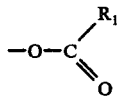

(as in an anhydride), and R may be alkyl, cycloalkyl, aryl cycloalkyl, or arylalkyl. The number of carbon atoms in the acyl-containing compound can vary widely, such as $C_2$ or larger, preferably $C_2$ to $C_{20}$. Examples of acylcontaining compounds are acetyl chloride, lauroyl chloride, benzoyl chloride, etc. Additionally, carbon monoxide, although not an acyl compound, per se, can be employed, as previously mentioned in the formylation reaction.

In the case of alkylation, the reagent can be olefinic, paraffinic, cycloparaffinic, or an alkyl halide. The size of the reagent is not critical although the larger the chain the more benefit per reaction site insofar as subsequent conversion of the coal liquefaction bottoms via liquefaction is concerned. Preferably $C_2$–$C_{20}$ olefins are employed, $C_2$–$C_{20}$ paraffins, and compounds having the general formula $R_2$—X wherein X is any halogen and $R_2$ can be alkyl, cycloalkyl, aryl cycloalkyl, or arylalkyl and, more preferably, having from 1–20 carbon atoms. Still more preferable are $C_2$–$C_8$ alkyl halides and $C_2$–$C_8$ olefins, e.g., ethylene, propylene, butylene, pentylene, butyl chloride, propyl bromide, ethyl chloride, ethyl iodide, etc.

Alcohols can also be employed as alkylating agents although a greater than stoichiometric amount of catalyst is usually required when an alcohol is the alkylating reagent. $C_1$–$C_{20}$ straight chain or branched compounds can be employed. Thus, in the formula $R_2$—X, X can also be an OH (hydroxyl) group.

The use of acyl halides or alkyl halides requires the use of an acid catalyst to promote the desired reaction. Catalysts that can be employed are broadly characterized as electron acceptors and may be commonly referred to as Friedel-Crafts catalysts. Examples of such catalysts are as follows: (1) Acidic halides such as Lewis acids, typified by metal halides of the formula $MX_n$ wherein M is a metal selected from Groups IIA, IIB, IIIA, IIIB, IVA, IVB, VA, VB, VIB or VIII of the Periodic Chart of the Elements, X is a halide from Group VIIA, and *n* is an integer from 2 to 6. Further examples of these materials are the fluorides, chlorides, or bromides, of aluminum, beryllium, cadmium, zinc, boron, gallium, titanium, zirconium, tin, lead, bismuth, iron, uranium, molybdenum, tungsten, tantalum, niobium, etc. Preferably, preferred materials are aluminum chloride, aluminum bromide, zinc chloride, ferric chloride, antimony pentafluoride, tantalum pentafluoride, boron trifluoride, etc. Additionally, these materials may be promoted with cocatalysts that are proton releasing substances, e.g., hydrogen halides, such as hydrogen chloride. Thus, a particularly preferred catalyst is HCl or $AlCl_3$/HCl. (2) Metal alkyls and halides of aluminum, boron, or zinc, e.g., triethyl aluminum, diethyl aluminum halide and the like. (3) Protonic acids commonly referred to as Bronsted acids and typified by sulfuric acid, hydrofluoric acid, hydrochloric acid, hydrobromic acid, fluorosulfuric acid, phosphoric acid, alkane sulfonic acids, e.g., methane sulfonic acid, trifluoroacetic acid, aromatic sulfonic acids such as para-toluene sulfonic acid, and the like, preferably HF or HCl. (4) Acidic oxides and sulfides (acidic chalcides) and modified zeolites, e.g., $SiO_2/Al_2O_3$. Additionally, these materials may be promoted with cocatalysts that are proton releasing substances, e.g., hydrogen halides such as hydrogen chloride and hydrogen fluoride. Since many sub-bituminous coals, bituminous coals, and lignite contain significant amounts (as much as 7% by weight) of clays and acidic oxides, the use of clays and acidic oxides either by promotion with acids (e.g., HCl, HF) or alone is particularly preferred. (5) Cation exchange resins. (6) Metathetic cation forming agents. Preferred catalysts are Lewis acids, Bronsted acids and acidic oxides.

When the metal halides are employed, normal precautions should be taken to avoid preferential reaction and consequently catalyst deactivation, by combination with water. Thus, the bottoms stream should be relatively dry, that is, less than 4 wt. % moisture, based on bottoms, preferably less than 2 wt. % moisture. Alternatively, the acyl halide can be mixed with the metal halide catalyst prior to contacting with the bottoms stream and thereby inhibit any deactivation of the metal halide catalyst due to reaction with water.

The metal halide can be utilized in any desired amount, e.g., catalytic amounts, based on the acylating agent. Thus, about 100 to 150 mol % metal halide, preferably 100 to 120 mol %, and more preferably 100 to 105 mol % metal halide can be employed.

Acylation conditions are not critical and temperatures may range from about −20° to 200° C., preferably 0° to 150° C., while pressures may range from 0 to 2000 psig, preferably atmospheric to 1500 psig. Contact times may also vary widely, e.g., a few seconds to several hours, preferably about 10 seconds to 60 minutes.

Alkylation is similarly accomplished by the use of known techniques. Thus, alkylation of the bottoms stream can be effected either with or without the addition of an extraneous catalyst. Normally, alkylation is effected either catalytically or thermally. However, in the case of the bottoms stream it is believed that the mineral matter present in coal may also act as a catalyst for alkylation.

Again, moisture should be avoided and the presence of water should be kept below the amounts mentioned above. Additionally, when olefins are employed, care should be taken to avoid conditions that could lead to olefin polymerization, e.g., lower temperatures. Preferably $C_2$ and terminal olefins are used and preferred catalysts are HF, $BF_3$, phosphoric acid, or acid promoted coal mineral matter or no extraneous catalyst. Generally, however, temperatures may range from about 0° to 300° C., preferably 25° to 250° C. with pressures ranging from about 0 to 2000 psig, preferably 0 to 1500 psig and contact times again ranging from a few seconds to several hours, preferably about 10 seconds to about 60 minutes. When no extraneous catalyst is employed, temperatures should be raised within the ranges shown to facilitate the process.

A variety of alkylation catalysts can be employed and these can be known and reported catalysts such as the Friedel-Crafts catalysts mentioned above, particularly the Lewis acids, or strong acids such as hydrofluoric acid, hydrochloric acid, sulfuric acid, fluorosulfuric acid, trifluoracetic acid, methane sulfonic acid, and the like as well as mixtures of Lewis acids with Bronsted acids for example as shown in U.S. Pat. No. 3,708,583. The amount of catalyst, if any, employed can range from 0.05 to 50 wt. % based on coal, preferably 0.05 to 10 wt. %.

At the conclusion of the alkylation or acylation reaction, an activated bottoms stream is separated from the reaction mixture by conventional techniques and optionally made free of any acid catalyst, as by washing. As mentioned above, the alkylation or acylation step can then be repeated to maximize the amount of reagent taken up by the unconverted coal.

Referring now to the drawing, coal from storage is crushed and ground to less than about 8 mesh NBS sieve size and fed by line 10 into drier 11 wherein substantially all the moisture is removed from the ground coal. Drying temperatures should be controlled so as to minimize caking (when caking coals are employed) and to prevent further polymerization of coal molecules. Drying temperatures of about 100° to 110° C. for about 0.5 to 4 hours can be employed. Dried coal in line 12 is slurried with recycle solvent from line 33 to form a solvent/coal slurry in line 12 and fed to liquefaction zone 16 operating at a temperature of about 840° F. and 1500 psig. Hydrogen is fed to the liquefaction zone through line 17. A preheat furnace (not shown) is often desirable to heat the slurry to reaction temperatures for liquefaction.

Light gases, such as CO, $CO_2$, $H_2S$ and light hydrocarbons are removed from the liquefaction zone by line 34 and the liquid product, in a slurry with unconverted coal, is recovered in line 18 and flashed in drum 19 to reduce the pressure, light gases and light hydrocarbons being flashed off in line 20 and an oil/coal slurry being recovered in line 21. The light hydrocarbons from line 34 can be treated by conventional means to remove $CO_2$ and $H_2S$ and then sent to a conventional steam reforming furnace wherein the hydrocarbon gases are reformed to produce hydrogen for use in the process, such as in line 17 (and line 29). The reformer 37 can also be used to handle off gases from the pipestill 22 (line 23) and fractionator 31 (line 32). The product of line 21 is then treated in a fractionator 22 which can be atmospheric or vacuum pipestill or both. Light gases are removed overhead in line 23 while a recycle solvent stream is removed via line 24 for treatment in solvent hydrotreater 28. Liquid product for upgrading by, e.g., hydrotreating, catalytic cracking, hydrocracking, etc., is recovered in line 25. A product bottoms stream containing the residuum and unconverted coal is taken off by line 26. A portion of the bottoms stream is removed via line 36 to avoid ash buildup due to recycle of the bottoms stream for alkylation/acylation before further liquefaction of the bottoms. This stream may be sent to hydrogen manufacture to generate hydrogen for use in the liquefaction zone or the solvent hydrotreater. The remainder of the bottoms stream, preferably the major portion thereof, is sent via line 27 to alkylation/acylation zone 38. An alkylating agent, e.g., propyl chloride, is introduced into zone 38 via line 39 while aluminum chloride catalyst is introduced via line **39*a*. The alkylation zone can be one or more reaction zones, optionally interspersed by washing steps, into each of which fresh alkylating agent and fresh catalyst are introduced. The alkylated bottoms is then forwarded, after suitable washing and drying, to line 12 for mixing with fresh coal feed and recycle solvent. Alternately, a separate liquefaction zone can be employed, the products from which are blended with the products from the main liquefaction zone 16**.

Recycle solvent is catalytically hydrogenated in hydrotreater 28, hydrogen being supplied in line 29, over a catalyst such as cobalt molybdate on an alumina support. Hydrotreated product is recovered in line 30 and fractionated in fractionator 31 from which recycle hydrogen donor solvent of the desired boiling range is recovered in line 33 and recycled to line 15 to slurry alkylated coal. Additional liquid product is recovered in line 35 and may be subjected to further upgrading. Any light gases formed during hydrotreating can be removed via line 32.

EXAMPLE 1

10.0 grams of liquefaction bottoms (Sample B) plus 2.0 grams $AlCl_3$ plus 15.0 grams 2-chloropropane were treated at 100° C. for 1 hour (pressure, max = 120 psig), cooled, water washed and dried to give 13.4 grams of product. The sample was subjected to liquefaction conditions identical to a sample that was not alkylated (Sample A). The results are shown in the table below. (The original sample was prepared at liquefaction conditions of 840° F., 1500 psig and in the same manner as samples prepared in U.S. Pat. No. 3,617,513.)

| | SAMPLE A | SAMPLE B |
|---|---|---|
| Alkylated | No | Yes |
| Liquefaction Information | | |
| Temperature, ° F. | 800 | 800 |
| Pressure, psig | 1390 | 1660 |
| Residence time, min. | 130 | 130 |
| Solvent | tetralin | tetralin |
| Dry Feed, g | 3.00 | 3.00 |
| Solvent, g | 6.00 | 6.00 |
| Solvent/feed, wt. ratio | 2/1 | 2/1 |
| Agitation rate, rpm | 120 | 120 |
| $H_2$ feet, wt. % dry feed | 2.0 | 2.0 |
| Chemical Analysis | | |
| Ash, wt. % solid residue | 28.70<br>29.77<br>30.84 | 43.75<br>43.72<br>43.69 |
| Yields, wt. % dry feed | | |
| Gas make | 1.4 | 3.98 |
| $H_2$ | — | — |
| $CO_x$ | 0.14 | 0.17 |
| $H_2S$ | — | — |
| $C_1$–$C_3$ | 1.17 | 3.66 |
| $C_4$+ | 0.09 | 0.15 |
| $H_2O$ make | 1.41 | 4.73 |
| Solid residue | 63.69<br>61.48<br>59.27 | 44.69<br>44.72<br>44.75 |
| Liquid make | 35.71 | 46.57 |
| Conversion | 38.52 | 55.28 |

What is claimed is:

1. In a process for obtaining liquid hydrocarbons from solid coal which comprises subjecting the coal to conversion in a liquefaction zone in the presence of hydrogen and/or a hydrogen donor solvent at temperatures ranging from 600°–1000° F and pressures of 300–3000 psig and recovering a bottoms stream containing substantially all of the unconverted coal, the improvement which comprises treating at least a portion of the unconverted bottoms stream with a reagent selected from the group consisting of alkylating and acylating agents and thereby introducing into the unreacted coal aliphatic and acyl radicals respectively and thereafter liquefying at least a portion of the treated bottoms stream at said liquefaction conditions including elevated temperatures and pressures.

2. The process of claim 1 wherein at least a portion of the treated bottoms stream is recycled to the liquefaction zone.

3. The process of claim 1 wherein at least a portion of the treated bottoms stream is subjected to the liquefaction conditions in a separate liquefaction zone.

4. The process of claim 1 wherein the reagent is an acylating agent and is selected from the group consisting of carbon monoxide, phosgene and compounds having the formula

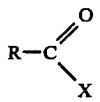

wherein R is an alkyl, cycloalkyl, arylcycloalkyl or arylalkyl radical and X is a halogen or anhydride derivative.

5. The process of claim 1 wherein the reagent is an alkylating agent and is selected from the group consisting of olefins, paraffins and compounds having the formula $R_2$—X wherein X is a halogen or hydroxyl and $R_2$ is an alkyl, cycloalkyl, arylcycloalkyl or arylalkyl radical.

* * * * *